US011447319B2

(12) United States Patent
Bray et al.

(10) Patent No.: US 11,447,319 B2
(45) Date of Patent: Sep. 20, 2022

(54) INNER FRAME BLANK FOR A PACK OF TOBACCO INDUSTRY PRODUCTS

(71) Applicant: British American Tobacco (Investments) Limited, London (GB)

(72) Inventors: Andrew Bray, London (GB); Steven Holford, London (GB)

(73) Assignee: BRITISH AMERICAN TOBACCO (INVESTMENTS) LIMITED, London (GB)

( * ) Notice: Subject to any disclaimer, the term of this patent is extended or adjusted under 35 U.S.C. 154(b) by 39 days.

(21) Appl. No.: 16/480,044

(22) PCT Filed: Jan. 16, 2018

(86) PCT No.: PCT/GB2018/050107

§ 371 (c)(1),
(2) Date: Jul. 23, 2019

(87) PCT Pub. No.: WO2018/134571

PCT Pub. Date: Jul. 26, 2018

(65) Prior Publication Data

US 2019/0389648 A1 Dec. 26, 2019

(30) Foreign Application Priority Data

Jan. 23, 2017 (GB) ..... 1701073

(51) Int. Cl.
*B65D 85/10* (2006.01)
*B65D 75/38* (2006.01)
(Continued)

(52) U.S. Cl.
CPC ..... *B65D 75/38* (2013.01); *B65D 75/5838* (2013.01); *B65D 81/2023* (2013.01); *B65D 81/2038* (2013.01); *B65D 85/1045* (2013.01)

(58) Field of Classification Search
CPC ..... B65D 85/1045; B65D 75/38; B65D 75/5838; B65D 81/2023; B65D 81/2038;
(Continued)

(56) References Cited

U.S. PATENT DOCUMENTS 4,300,676 A 11/1981 Focke
6,164,444 A * 12/2000 Bray ..... B65D 85/10 206/268

(Continued)

FOREIGN PATENT DOCUMENTS

CN 203450510 U 2/2014
DE 102008035467 A1 2/2010

(Continued)

OTHER PUBLICATIONS

English translation of DE 102008035467 (Year: 2010).*

(Continued)

*Primary Examiner* — Steven A. Reynolds
(74) *Attorney, Agent, or Firm* — Cantor Colburn LLP

(57) ABSTRACT

An inner frame blank for a pack of tobacco industry products, where the inner frame blank is foldable to form an inner frame for holding a group of tobacco industry products, and the inner frame blank has a first major panel and a second major panel joined to opposing edges of a central panel such that the first and second major panels are foldable relative to the central panel to form opposing sides of the inner frame, and where the inner frame blank also has an aperture in at least the central panel that defines an extraction opening for removing tobacco industry products from within the inner frame when the inner frame blank is folded to form the inner frame.

16 Claims, 9 Drawing Sheets

(51) Int. Cl.
*B65D 75/58* (2006.01)
*B65D 81/20* (2006.01)

(58) Field of Classification Search
CPC ..... B65D 85/10; B65D 85/1009; A24F 15/02; A24F 15/12; A24F 15/16; A24F 15/06
USPC ..... 206/264
See application file for complete search history.

(56) References Cited

U.S. PATENT DOCUMENTS

| | | | | |
|---|---|---|---|---|
| 8,091,703 | B2 | 1/2012 | Marchetti | |
| 2012/0291401 | A1* | 11/2012 | Mitten | B65D 5/543 53/415 |
| 2013/0227915 | A1* | 9/2013 | Steffens | B65B 29/00 53/405 |
| 2014/0374287 | A1* | 12/2014 | Holford | B65D 85/10484 206/248 |
| 2015/0021219 | A1 | 1/2015 | Seyfferth De Oliveira | |
| 2018/0022538 | A1* | 1/2018 | Li Vigni | B65D 81/203 206/259 |
| 2018/0339846 | A1* | 11/2018 | Eggen | B65D 85/10568 |

FOREIGN PATENT DOCUMENTS

| | | | |
|---|---|---|---|
| JP | 2014503433 | A | 2/2014 |
| KR | 20100058455 | A | 6/2010 |
| WO | 2008062159 | A1 | 5/2008 |
| WO | 2011009520 | A1 | 1/2011 |
| WO | 2012082907 | A1 | 6/2012 |
| WO | 2016001826 | A1 | 1/2016 |
| WO | 2016087828 | A1 | 6/2016 |
| WO | 2016120847 | A1 | 8/2016 |
| WO | 20161120847 | A1 | 8/2016 |

OTHER PUBLICATIONS

International Search Report for corresponding application PCT/GB2018/050107 filed Jan. 16, 2018; dated Mar. 15, 2018.
Japanese Office Action for Japanese Application 2019-539257; Report dated May 25, 2021.
Korean Office Action for corresponding application 10-2021-7007758; Report dated Mar. 10, 2022.
Korean Office Action for corresponding application 10-2021-7007758; Report dated Jul. 7, 2022.

* cited by examiner

INNER FRAME BLANK FOR A PACK OF TOBACCO INDUSTRY PRODUCTS

FIELD

The invention relates to an inner frame blank for a pack of tobacco industry products, a wrapped bundle of tobacco industry products that includes an inner frame formed from the inner frame blank, and to a pack of tobacco industry products that includes an inner frame formed from the inner frame blank.

BACKGROUND

Some cigarette packs include a wrapped bundle that consists of a frame that at least partly surrounds a group of cigarettes, and a wrapper that encloses the frame and the cigarettes. The wrapper has a removable or openable portion for providing access to the cigarettes via an opening in the frame.

SUMMARY

According to a first aspect of the invention, there is provided an inner frame blank for a pack of tobacco industry products, the inner frame blank being foldable to form an inner frame for holding a group of tobacco industry products, the inner frame blank comprising a first major panel and a second major panel joined to opposing edges of a central panel such that the first and second major panels are foldable relative to the central panel to form opposing sides of said inner frame, and wherein the inner frame blank further comprises an aperture in at least the central panel that defines an extraction opening for removing tobacco industry products from within said inner frame when the inner frame blank is folded to form said inner frame.

The aperture may extend from the central panel into at least one of the first and second major panels.

In some examples, the inner frame blank may comprise a closed figure that defines the aperture. That is, the aperture is surrounded by material of the inner frame blank on all sides such that the aperture does not extend an edge of the inner frame blank.

The inner frame blank may further comprise at least one side panel attached to an edge of the first major panel or the second major panel such that the side panel is foldable to extend between said opposing sides of said inner frame when the inner frame blank is folded to form said inner frame.

A strengthening tab may extend from the side panel such that, when the inner frame blank is folded to form said inner frame, the strengthening tab at least partially overlaps the central panel.

The inner frame blank may further comprise an end panel joined to an edge of one of the first major panel and the second major panel, the end panel being opposite the central panel.

The opposing edges of the central panel may comprise score lines.

According to a further aspect of the invention, there is also provided an inner frame for a pack of tobacco industry products, the inner frame being formed by folding the inner frame blank described above.

According to a further aspect of the invention, there is also provided a wrapped bundle of tobacco industry products, the wrapped bundle comprising a group of tobacco industry products, an inner frame formed by folding the inner frame blank described above about the group of tobacco industry products, and a wrapper enclosing the inner frame and the tobacco industry products.

According to a further aspect of the invention, there is also provided a wrapped bundle of tobacco industry products, the wrapped bundle comprising a group of tobacco industry products, an inner frame folded about the tobacco industry products, and a wrapper enclosing the inner frame and tobacco industry products, the inner frame comprising a first major panel and a second major panel joined to opposing edges of a central panel such that the first and second major panels are folded relative to the central panel to form opposing sides of the inner frame, and wherein the inner frame further comprises an aperture in at least the central panel that defines an extraction opening for removing tobacco industry products from within the inner frame, and wherein the wrapped bundle further comprises an adhesive label adhered to the wrapper to cover the extraction opening of the inner frame.

The wrapper may comprise an access flap that is aligned with the extraction opening.

The wrapped bundle may further comprise a label applied to the access flap, the label comprising an adhesive such that the access flap is resealable.

The label may cover the access flap and overlie at least part of the wrapper outside of the access flap.

The adhesive may be pressure sensitive adhesive.

The wrapper may be sealably wrapped about the inner frame and tobacco industry products.

The wrapper may comprise fin seals.

The interior of the wrapped bundle may comprise a pressure differential relative to the exterior of the wrapped bundle.

In one example, the pressure differential may comprise at least a partial vacuum within the wrapped bundle.

The wrapped bundle may further comprise a one-way valve for extracting air from within the wrapped bundle or for inserting gas into the wrapped bundle.

The inner frame may further comprise a valve aperture that is aligned with the one-way valve.

The aperture of the inner frame blank may define an extraction opening in the inner frame that extends over an edge of the inner frame, and the edge may comprises a fold in the inner frame.

According to a further aspect of the invention, there is also provided a pack of tobacco industry products, the pack comprising the wrapped bundle described above, and a pack outer adapted to receive the wrapped bundle.

The pack outer may comprise a hinged-lid pack outer having a parallelepiped base in which the wrapped bundle is received such that a portion of the wrapped bundle protrudes from the base, and a parallelepiped lid arranged to cover the portion of the wrapped bundle that protrudes from the base.

BRIEF DESCRIPTION OF THE DRAWINGS

Embodiments of the invention will now be described, by way of example only, with reference to the accompanying drawings, in which.

DETAILED DESCRIPTION

Figure 1:
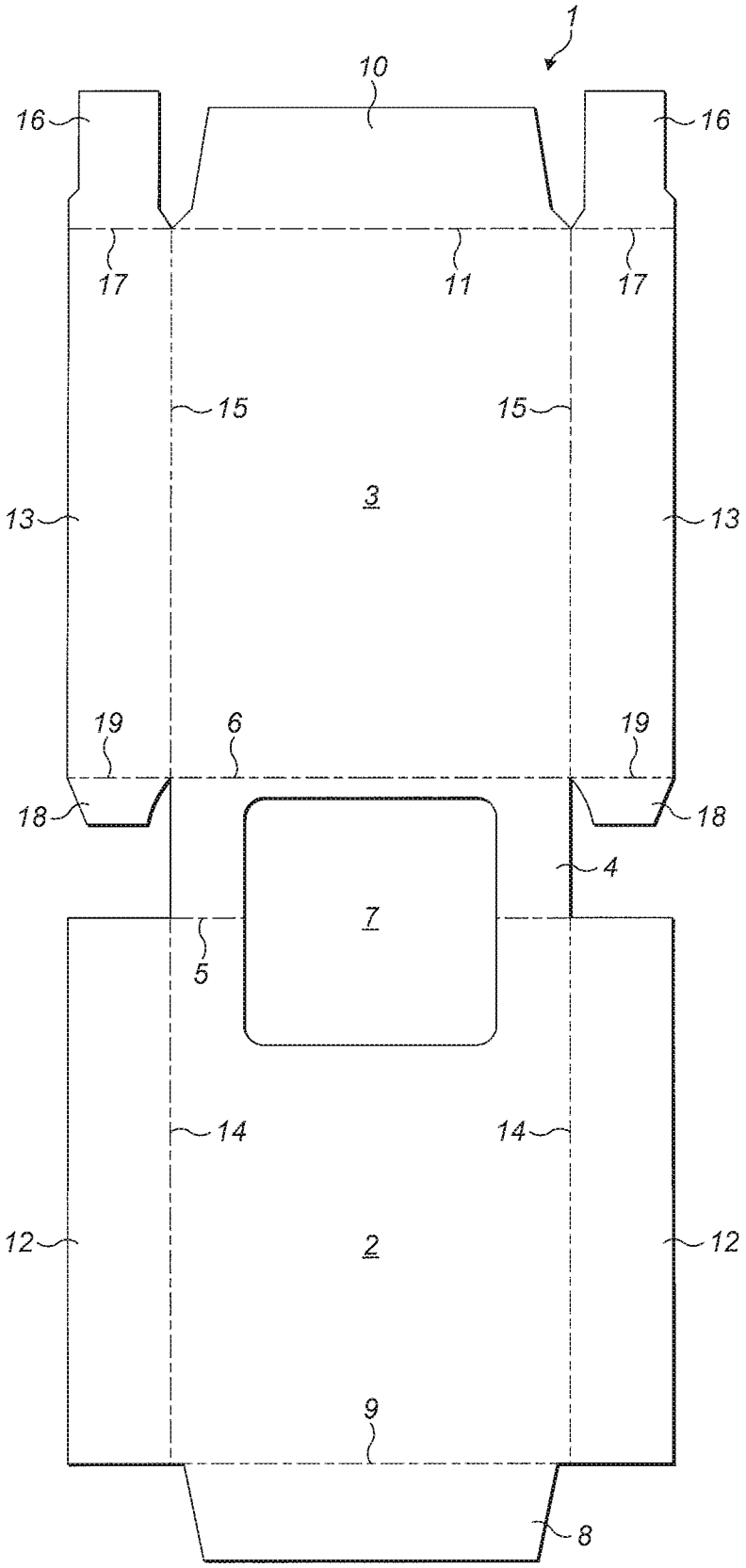
FIG. 1 shows an inner frame blank for an inner frame of a tobacco industry pack.

As illustrated in FIG. 1, the inner frame blank 1 comprises a first major panel 2, a second major panel 3, and a central panel 4. The first major panel 2 is joined to a first edge 5 of the central panel 4 and the second major panel 3 is joined to a second edge 6 of the central panel 4. The first edge 5 and second edge 6 of the central panel 4 are opposite one another. In this way, when the inner frame 1 is erected, as described further hereinafter, the first and second major panels 2, 3 are folded to form sides of the erected inner frame and the central panel 4 forms an end of the erected inner frame.

The first and second major panels 2, 3 are joined to the central panel 4 along fold lines that form the first and second edges 5, 6. The fold lines may be formed by weakening the material of the inner frame blank 1, for example by scoring or by providing a line of perforations.

In one example, the inner frame blank 1 is made of a card material. In other examples, the inner frame blank 1 is made of a plastic material. In further examples, the inner frame blank is made of a paper material. In some examples, the inner frame blank 1 is made of a laminate material, for example card with a plastic coating.

Also shown in FIG. 1, the inner frame blank 1 includes an aperture 7. The aperture 7 is formed in the central panel 4, so that cigarettes can be removed from the erected inner frame (as will become apparent hereinafter). In this example, the aperture 7 extends from the central panel 4, across the first edge 5, and into the first major panel 2. The aperture 7 may additionally or alternatively extend from the central panel 4, across the second edge 6, and into the second major panel 3 in other embodiments.

As illustrated in FIG. 1, the aperture 7 is a closed shape. That is, the aperture 7 is enclosed on all sides. The aperture 7 of this example is formed in the central panel 4 and the first major panel 2, and is enclosed on all sides—it is a closed shape.

The inner frame blank 1 of FIG. 1 also includes further panels for forming the inner frame. In particular, a first end panel 8 extends from an opposite edge 9 of the first major panel 2 to the central panel 4, and a second end panel 10 extends from an opposite edge ii of the second major panel 3 to the central panel 4. When the inner frame is erected, the first and second end panels 8, 10 overlie each other to form an end wall of the inner frame that is opposite the central panel 4.

Furthermore, the inner frame blank 1 of FIG. 1 includes side panels for forming side walls of the erected inner frame. A first pair of side panels 12 extend from edges 14 of the first major panel 2 that are adjacent and perpendicular to the first edge 5 and central panel 4. Similarly, a second pair of side panels 13 extend from edges 15 of the second major panel 3 that are adjacent and perpendicular to the second edge 6 and central panel 4. When the inner frame is erected, the side panels 12, 13 overlie each other to form opposing side walls of the inner frame.

In addition, the inner frame blank 1 of FIG. 1 includes strengthening tabs. In particular, as illustrated in FIG. 1, a first pair of strengthening tabs 16 extend from ends 17 of the second pair of side panels 13 adjacent the second end panel 10. In the erected inner frame the first pair of strengthening tabs 16 overlap the first and/or second end panel 8, 10.

A second pair of strengthening tabs 18 extend from an opposing end 19 of the second pair of side panels 13, adjacent to the central panel 4. In the erected inner frame, this second pair of strengthening tabs 18 overlie the central panel 4. The second pair of strengthening tabs 18 are of restricted length so that they do not extend across the aperture 7 when the inner frame is erected.

The first and second pairs of strengthening tabs 16, 18 help to provide rigidity and strength to the erected inner frame.

Figure 2:
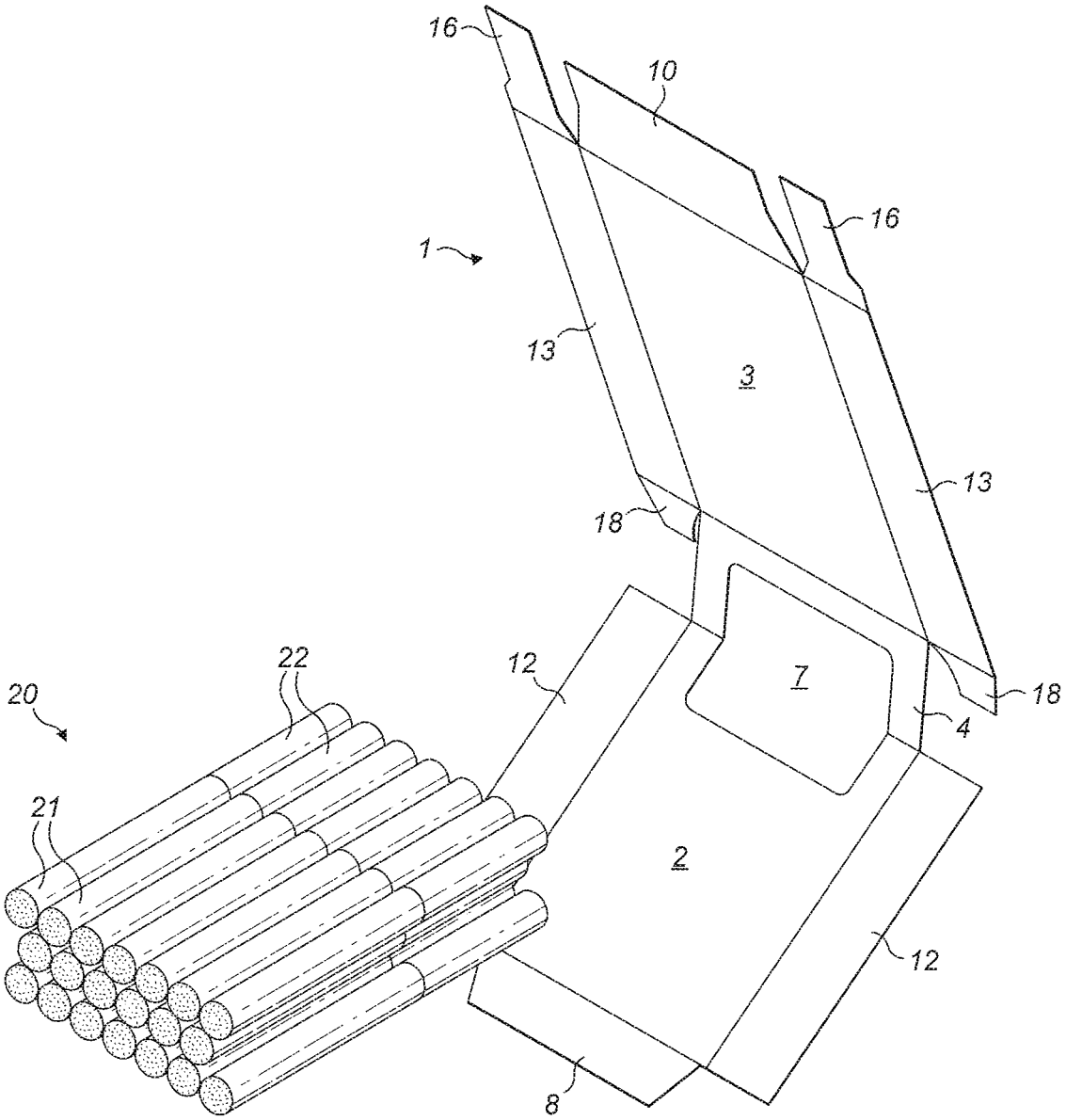
FIG. 2 shows the blank of FIG. 1 being wrapped about a group of tobacco industry products.

FIG. 2 illustrates part of a method of assembling the inner frame blank 1 about a group of tobacco industry products 20. In this example, the tobacco industry products 20 are cigarettes 21 with filters 22 at one end of each cigarette 21. As shown in FIG. 2, the group of cigarettes 20 is wrapped in the inner frame blank 1 by placing the filters 22 of the cigarettes 21 adjacent to, or against, the central panel 4, and the first and second major panels 2, 3 are folded against the sides of the group of cigarettes 20. Following this, the end panels 8, 10, side panels 12, 13, and strengthening tabs 16, 18 can be folded to form the end and sides of the erected inner frame. The end panels 8, 10, side panels 12, 13, and strengthening tabs 16, 18 can optionally be joined to each other and/or to the central panel 4, for example using an adhesive or heat sealing.

Figure 3:
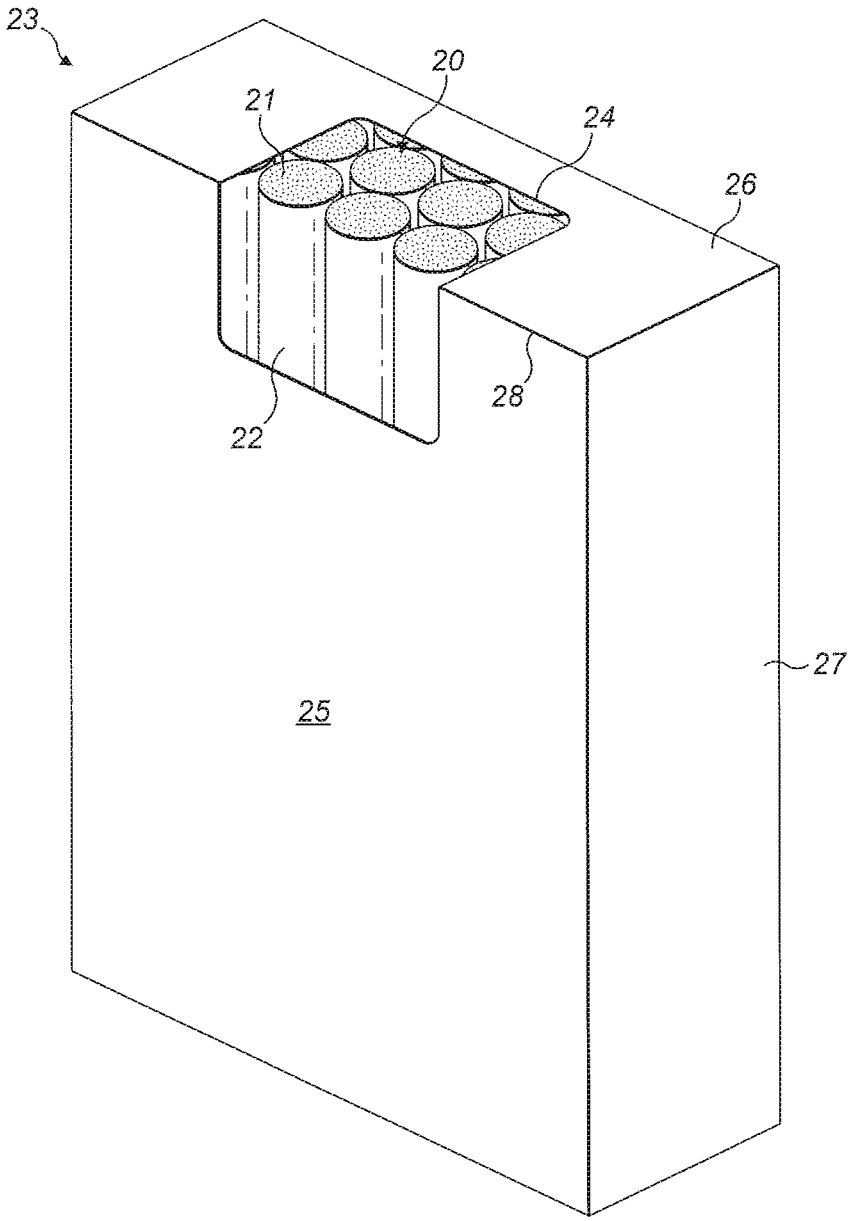
FIG. 3 shows an inner frame formed from the blank of FIG. 1, containing a group of tobacco industry products.

FIG. 3 illustrates the erected inner frame 23, which contains the group of cigarettes 20 that can be extracted via an extraction opening 24 formed by the aperture 7 of the inner frame blank 1 (see FIG. 1 and FIG. 2). As shown, the filters 22 of the some of the cigarettes 21 can be grasped through the extraction opening 24 for removal from the inner frame 23. Once some cigarettes 21 have been removed, the others can be moved into alignment with the extraction opening 24 for removal.

As illustrated in FIG. 3, the erected inner frame 23 comprises a front face 25, which is formed from the first major panel 2 of the inner frame blank 1 (see FIG. 1 and FIG. 2), a rear face (not shown), which is formed from the second major panel 3 of the inner frame blank 1 (see FIG. 1 and FIG. 2), and an end face 26, which is formed from the central panel 4 of the inner frame blank 1 (see FIG. 1 and FIG. 2).

The extraction opening 24 of this example extends from the end face 26 into the front face 25 because the aperture 7 of the inner frame blank 1 extended from the central panel 4 into the first major panel 2. In this example, as shown, the extraction opening 24 extends over a front edge 28 of the erected inner frame 23. However, in alternative examples the aperture 7 is only present in the central panel 4, and so the extraction opening 24 is formed solely in the end face 26 of the erected inner frame. Cigarettes can be extracted lengthwise through such an extraction opening. In addition, the aperture 7 of the inner frame blank 1 may additionally extend into the second major panel 3, in which case the extraction opening 24 would extend into the rear face (not shown) of the erected inner frame 23.

Furthermore, the inner frame 23 has opposing side faces 27 (only one shown), which are formed from the first and second pairs of side panels 12, 13 of the inner frame blank 1 (see FIG. 1 and FIG. 2) that are folded to overlie each other. In this example, the first pair of side panels 12 are folded to form the outside of the side faces 27 of the inner frame 23, but it will be appreciated that the second pair of side panels 13 may alternatively by folded to form the outside of the side faces 27 of the inner frame 23. The first side panel 12 and the second side panel 13 of each side face 27 may be joined together, for example using an adhesive or heat seal.

Also, the inner frame 23 has a bottom face (not shown) which is opposite the end face 36. The bottom face is formed from the first end panel 8 and second end panel 10 of the inner frame blank 1 (see FIG. 1 and FIG. 2). In this example, the first end panel 8 is folded to form the outside of the bottom face of the inner frame 23, but it will be appreciated that the second end panels 10 may alternatively be folded to form the outside of the bottom face of the inner frame 23. The first and second end panels 8, 10 are folded to overlie each other, and may be joined together, for example using an adhesive or heat seal.

Furthermore, the first strengthening tabs 16 (not visible in FIG. 3, see FIG. 1) have been folded and are arranged against at least one of the first and second end panels 8, 10 that form the bottom face of the inner frame 23. The first strengthening tabs 16 may be joined to the first and/or second end panels 8, 10, for example by an adhesive or heat seal.

In addition, the second strengthening tabs 18 (not visible in FIG. 3, see FIG. 1) may be folded to underlie the end face 26 of the erected inner frame. The second strengthening tabs 18 may be joined to the central panel 4 that forms the end face 26, for example by an adhesive or heat seal. The first and second strengthening tabs 16, 18 help to increase the structural rigidity and strength of the erected inner frame 23.

As is apparent in FIG. 3, the group of cigarettes 20 is entirely surrounding by the inner frame 23 with the exception of the extraction opening 24. That is, as explained, the inner frame 23 has six sides that at least partially surround the group of cigarettes 20 on all sides.

As explained previously, the aperture 7 in the inner frame blank 1 (see FIG. 1) is a closed shape. In this way, the erected inner frame 23 has good structural rigidity and strength in the region of the extraction opening 24 because the first major panel 2, second major panel 3, and the central 4 are integrally attached to each other.

Furthermore, the opposing side faces 27 of the erected inner frame 23 also help to increase the structural rigidity, particularly if they are joined together, as described. Moreover, the first strengthening tabs 16 will help to increase the structural rigidity and strength of the inner frame 23 in the region of the bottom face, especially if the first strengthening tabs 16 are joined to the end panels 8, 10. The second strengthening tabs 18, being present underneath the central panel 4 that forms the end face 26 of the inner frame 23, will also help to increase the structural rigidity and strength of the inner frame 23, particularly around the extraction opening 24 which might otherwise be a weaker part of the inner frame 23. Joining the second strengthening tabs 18 to the central panel 4, for example by adhesive, will further help to increase the structural rigidity and strength of the inner frame 23 in the region of the extraction opening 24.

Figure 4:
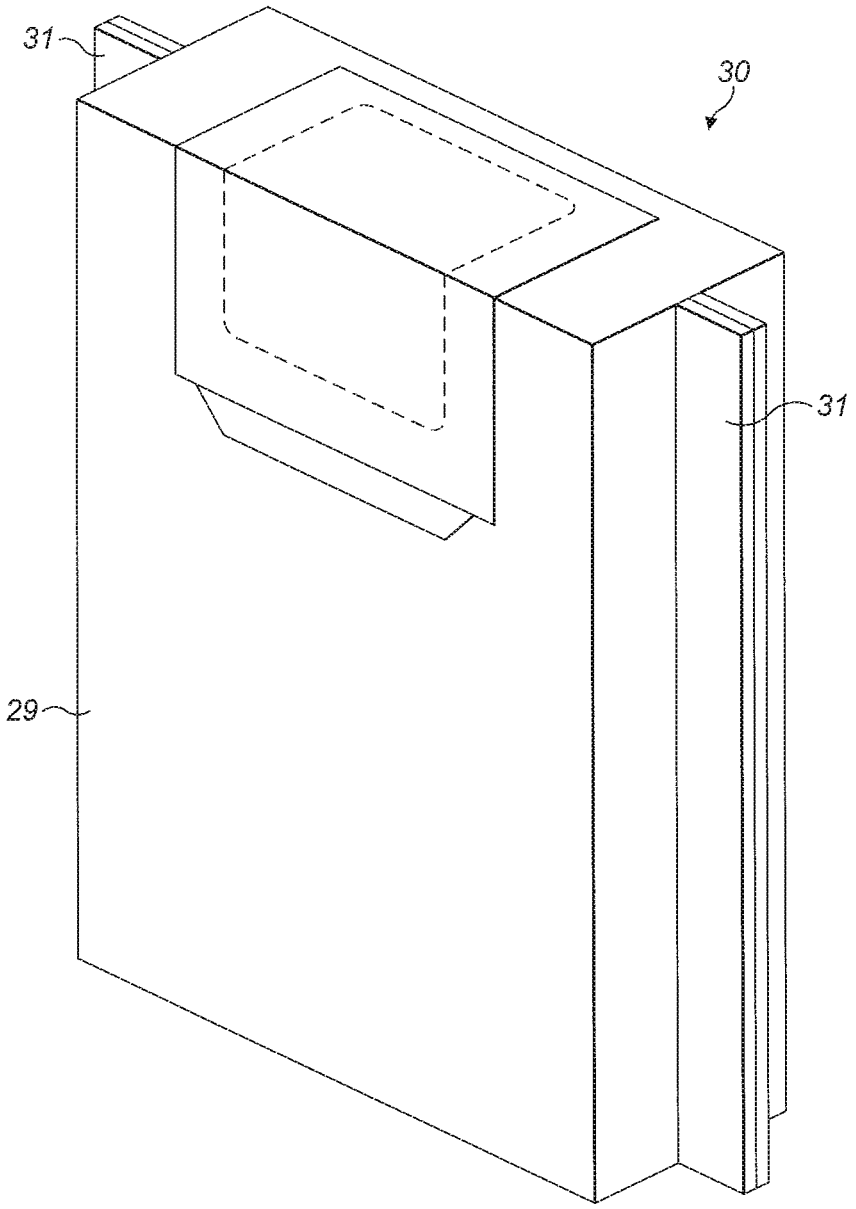
FIG. 4 shows a wrapped bundle of tobacco industry products that includes the inner frame and tobacco industry products of FIG. 3.

As illustrated in FIG. 4, the erected inner frame (23, see FIG. 3) and group of cigarettes (20, see FIG. 3) therein may be enclosed in a wrapper 29 to form a wrapped bundle 30.

The wrapper 29 is formed from a flexible sheet material, for example a flexible polymer wrap. The wrapper 29 may be a laminate material that could include foil, metallised polymer adhesive, and other such packaging materials. In a preferred embodiment, the barrier material 21 comprises a laminate having three layers—outer layers of orientated polypropylene and a middle layer of metal foil, for example aluminum foil. In another example, the wrapper 29 comprises a single layer of polypropylene, which may be orientated polypropylene. The wrapper 29 may be provided with printing, for example ink.

As shown in FIG. 4, the wrapper 29 may be sealed about the inner frame 23 and group of cigarettes 20 by fin seals 31. In this example, side fin seals 31 are formed adjacent to the opposing side faces 27 of the inner frame 23 (see FIG. 3), and a further fin seal (not shown) is formed across the back face of the inner frame 23, perpendicular to the side fin seals 31.

The fin seal 31 may be formed using heat, for example using heated plates that press parts of the wrapper 29 together to form the fin seal 31. Alternatively, induction sealing or ultrasonic sealing may be used to form the fin seal 31. Each of these sealing processes joins one part of the wrapper 29 to another to form a fin seal 31.

In alternative examples, the wrapper 29 may be heat sealed about the inner frame 23 and group of cigarettes 20. In this case, the ends of the wrapper 29 may be formed into overlapping flaps that lay against the faces of the inner frame 23, the flaps are then pressed against each other by heated plates to join them together by heat sealing. The heated plates may alternatively be induction or ultrasonic sealers that cause heating of the material of the wrapper 29 to join the flaps together.

In further alternative examples, the wrapper 29 may be sealed about the inner frame 23 and group of cigarettes 20 using adhesive. In this case, the ends of the wrapper 29 may be formed into overlapping flaps that are arranged against the faces of the inner frame 23 and adhered to each other and/or to the inner frame 23.

Figure 5:
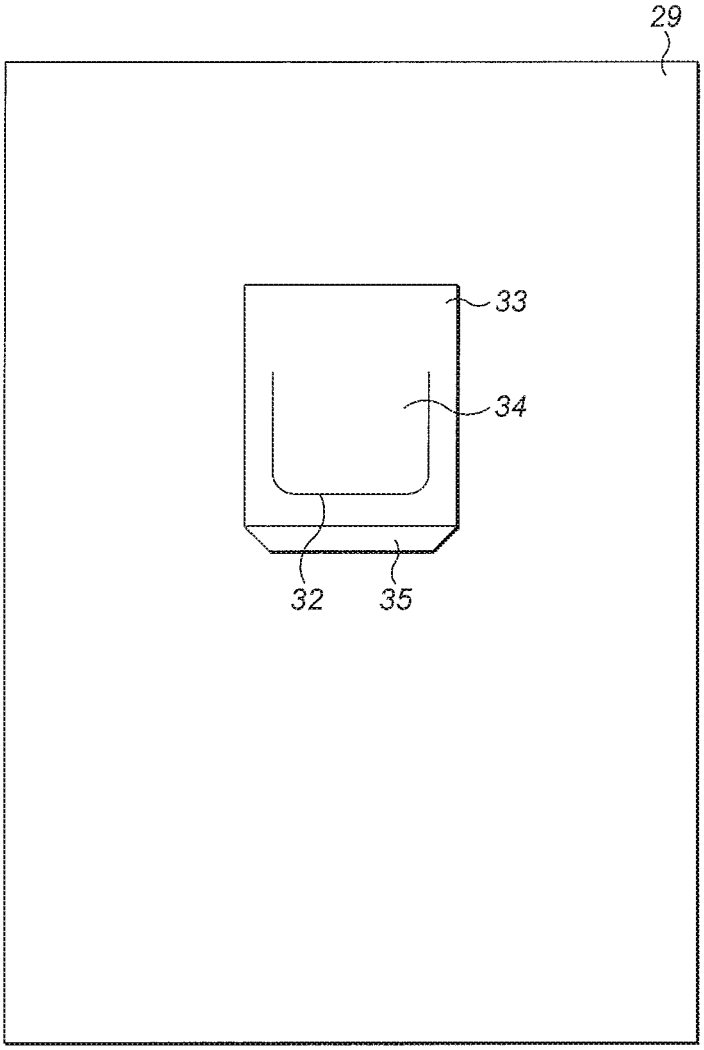
FIG. 5 shows a wrapper for the wrapped bundle of FIG. 4.

The example wrapper 29 of FIG. 5 is for wrapping about an inner frame 23 and group of cigarettes 20 to form the wrapped bundle 30 of FIG. 4. The wrapper 29 includes a line 32 that defines an access flap 34 that forms an opening when the wrapped bundle 30 (see FIG. 4) is opened. In this example, the line 32 is 'U' shaped so that the access flap 34 remains attached to the wrapper 29. In an alternative example, the line 32 defines a closed shape and the access flap 34 can be removed from the wrapper 29. The line 32 may be a through cut, or it may be a line of weakness, for example a score line or a line of perforations. The line of weakness may be formed, for example, by a mechanical cutter or a laser scorer.

The wrapper 29 also includes a resealing label 33 that is adhered to the outside surface of the wrapper 29 using a pressure sensitive adhesive. The resealing label 33 is adhered over the access flap 34 defined by the line 32. The resealing label 33 is larger than the access flap 34 so that edges of the resealing label 33 are joined to a part of the wrapper 29 outside of the access flap 34. The resealing label 33 may include a pull tab 35 for pulling the adhesive label 33. The pull tab 35 may be free from adhesive, or adhesive on the pull tab 35 may be masked or neutralised. In this way, the resealing label 33 provides for a resealable opening in the wrapper 29.

The resealing label 33 may be made of a flexible sheet material, for example a polypropylene or laminate. The resealing label 33 may include a foil layer and/or printing.

Figure 7:
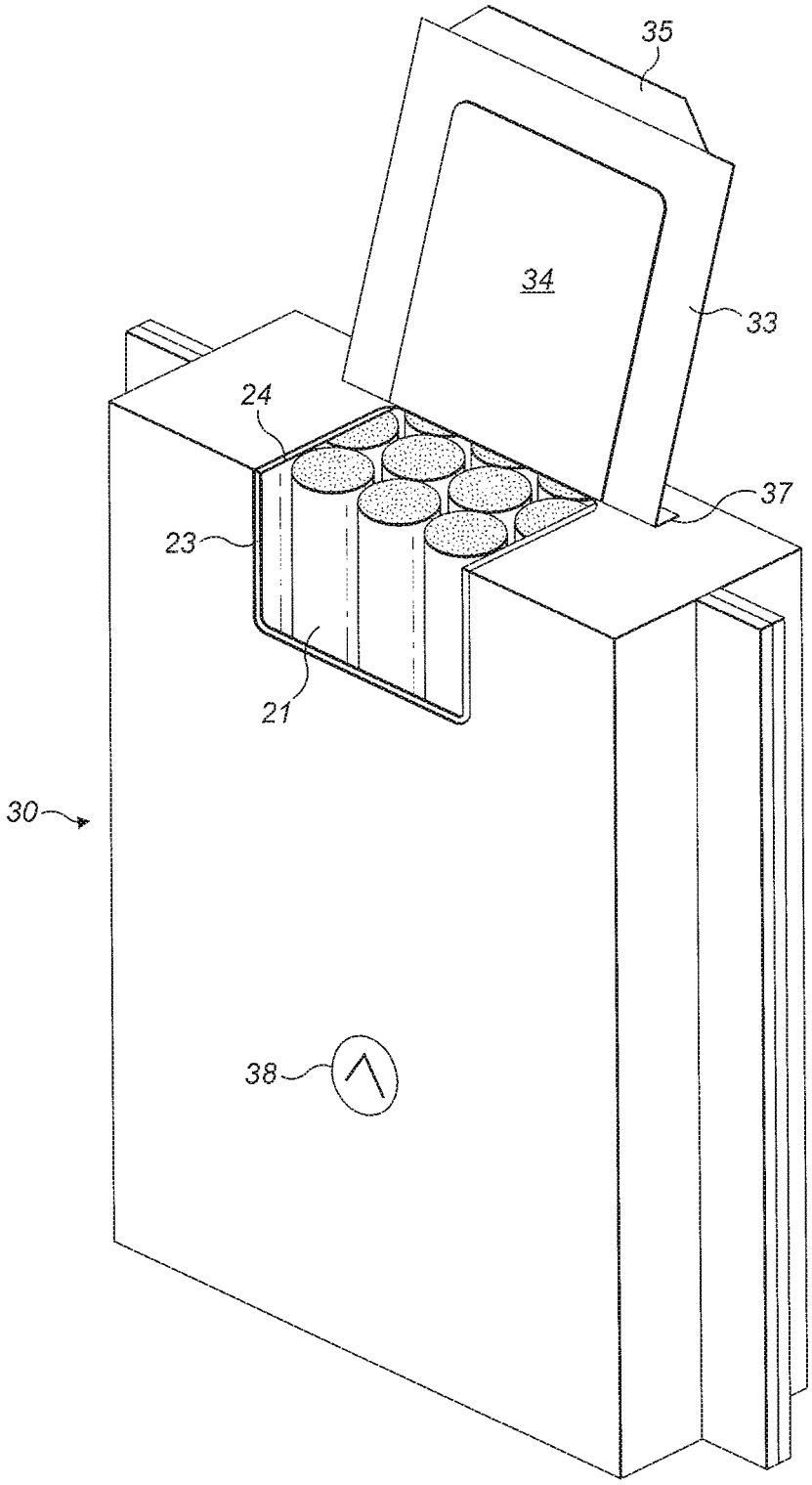
FIG. 7 shows a wrapped bundle after it has been opened.

As illustrated in FIG. 7, when the resealable label 33 is lifted using the pull tab 35 it peels away from the wrapped bundle 30 and lifts the access flap 34 to expose the cigarettes 21 through the extraction opening 24 of the inner frame 23. The pressure sensitive adhesive permits the resealing label 33 and access flap 34 to be replaced, resealing the wrapped bundle 30.

Figure 6:
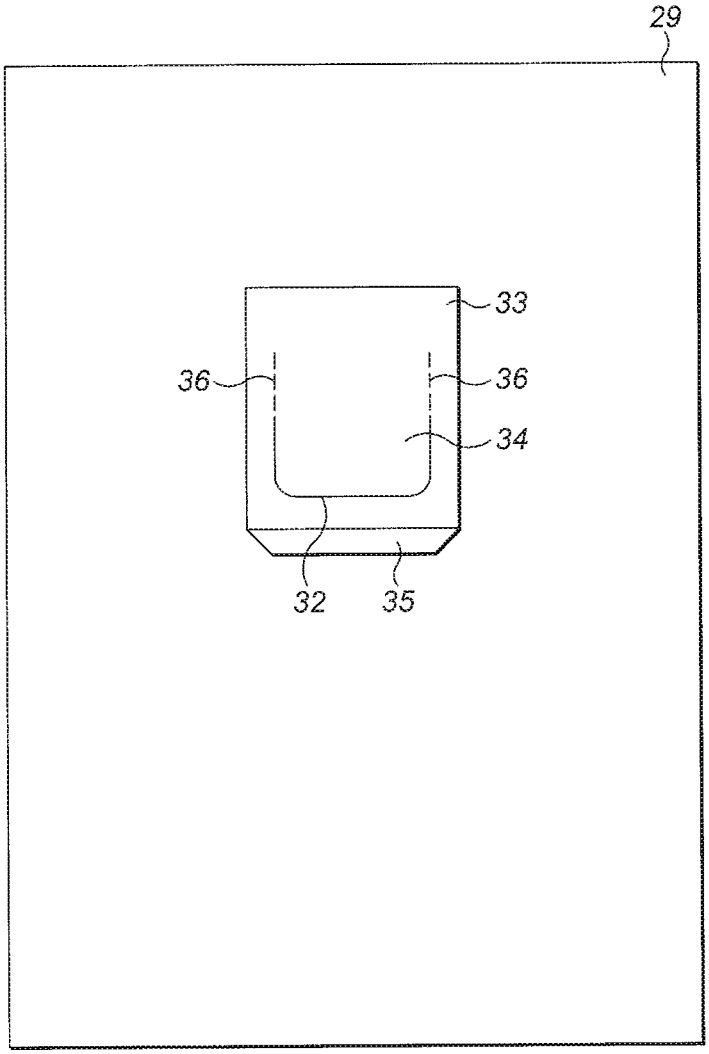
FIG. 6 shows an alternative wrapper for the wrapped bundle of FIG. 4.

In the alternative example of the wrapper 29, illustrated in FIG. 6, the line 32 is a 'U' shaped through cut located towards the pull tab 35, and further lines of weakness 36 extend from the ends of the line 32. In this way, when the pull tab 35 is pulled the line 32 separates and the wrapper 29 material is then torn along the lines of weakness 36 to form the access flap 34 shown in FIG. 7.

Preferably, the 'U' shaped line 32 is located entirely on the front face 25 of the inner frame 23 and the lines of weakness 36 extend over the front edge 28 of the inner frame 23 (see FIG. 3). This arrangement may provide improved the sealing of the line 32 by the resealing label 33 prior to the wrapped bundle 30 first being opened.

In some examples, the resealing label 33 is adhered to the wrapper 29 using only pressure sensitive adhesive. In this way, the resealing label 33 can be reattached to the wrapper 29, while within the area of the access flap 34 the pressure sensitive adhesive provides enough sticking force to lift the access flap 34 during opening of the wrapped bundle 30. In other examples, an area of permanent adhesive is provided between the resealing label 33 and the access flap 34, and the remainder of the resealing label 33 is provided with pressure sensitive adhesive. This may ensure that the access flap 34 is lifted when the pull tab 35 is pulled to open the wrapped bundle 30.

Additionally or alternatively, a rear edge 37 (see FIG. 7) of the resealing label 33 may be adhered to the wrapper 29 using a permanent adhesive. This would prevent the resealing label 33 being removed from the wrapped bundle 30.

In various embodiments of the present invention, a pressure differential is provided between the interior and exterior of the wrapped bundle 30 to help preserve the flavour and freshness of the cigarettes 21. In a preferred example, the pressure differential is a partial vacuum that can be created by evacuating at least some of the air from the wrapped bundle 30. In another example, the pressure differential is a positive pressure within the wrapped bundle 30 that can be created by pumping a gas into the wrapped bundle 30. A positive pressure means a pressure that is above atmospheric pressure, i.e. a pressure greater than about 1 bar at standard ambient temperature, i.e. 25 degrees Celsius.

Preferably, the wrapper 29 is sealed about the inner frame 23 and group of cigarettes 20 to allow pressure differential to be maintained until the wrapped bundle 30 is opened. In this case, the fin seals 31 described with reference to FIG. 4 are preferred. Preferably, the wrapper 29 is impermeable to air. The wrapped bundle 30 may be hermetically sealed.

A partial vacuum within the wrapped bundle 30 can be provided by evacuating air from within the wrapped bundle 30. This may be performed by exposing the partially wrapped bundle 30 to a reduced-pressure environment prior to forming the last of the seals. Similarly, a positive pressure may be provided by exposing the partially wrapped bundle 30 to an increased-pressure environment prior to forming the last of the seals.

Alternatively, as illustrated in FIG. 7, the wrapped bundle 30 may include a one-way valve 38 through which air can be removed or inserted after the wrapper 29 has been wrapped and sealed about the inner frame 30 and group of cigarettes 20. The one-way valve 38 may be adhered over a hole through the wrapper 29 so that air can be removed from the wrapped bundle 30 or inserted into the wrapped bundle via the hole in the wrapper 30 and the one-way valve 38. A suction pipe, vacuum chamber or pump may be used to remove or insert air through the one-way valve 38.

It will be appreciated that varying degrees of air may be evacuated from the wrapped bundle 30, but that the pressure within the wrapped bundle 30 will be reduced. It will also be appreciated that not only air may be evacuated from the wrapped bundle 30, and any gas that is present at that time can be evacuated.

In various examples, the partial vacuum within the wrapped bundle 30 has a pressure of less than 1 bar at standard ambient temperature, i.e. 25 degrees Celsius.

In some examples, at standard ambient temperature the partial vacuum within the wrapped bundle 30 is less than 500 millibar, for example between 40 and 300 millibar. In other embodiments, at standard ambient temperature the partial vacuum within the wrapped bundle 30 is less than 150 millibar, preferably about 80 millibar. However, it will be appreciated that the partial vacuum within the wrapped bundle 30 may be any value less than 1 bar.

Figure 8:
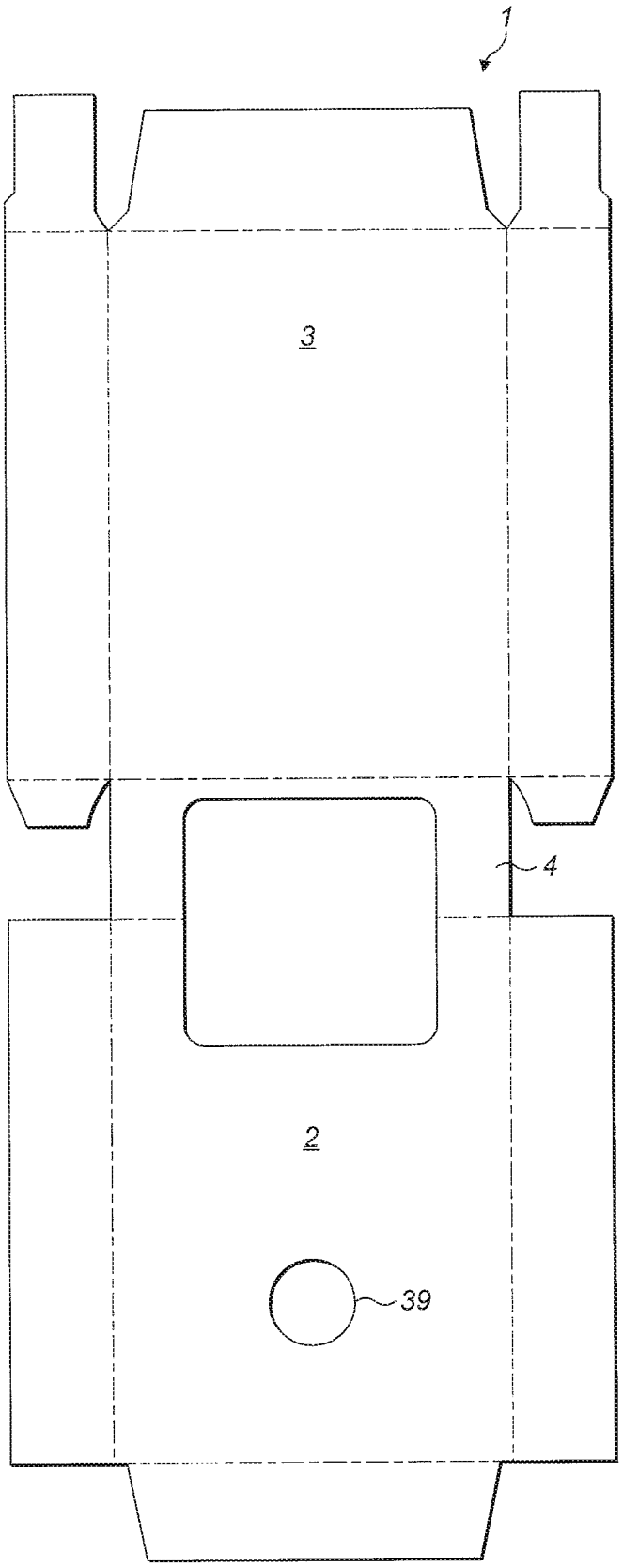
FIG. 8 shows an alternative blank for an inner frame of a tobacco industry pack.

In examples where the wrapped bundle 30 has a one-way valve 38, as illustrated in FIG. 7, the inner frame 23 may be provided with a valve aperture 39. In particular, as shown in FIG. 8, the first major panel 2 of the inner frame blank 1 may include a valve aperture 39 that is aligned with the valve 38 in the wrapped bundle 30 once the wrapper 29 is wrapped about the erected inner frame 23 (see FIG. 7). The valve aperture 39 permits air to more freely move from the interior of the inner frame 23 within the wrapped bundle 30 through the one-way valve 38 when suction is applied to the wrapped bundle 30.

It will be appreciated that the one-way valve 38 may be placed on an alternative face of the wrapped bundle 30, for example the rear face or a side face, and in that case the valve aperture 39 can be provided in a corresponding location on the inner frame blank 1.

If the wrapped bundle 30 is provided with a partial vacuum, as described above, then the pressure difference causes a compressive force to be created that acts on the contents of the wrapped bundle 30, in particular the inner frame 23 and group of cigarettes 20. The additional structural rigidity and strength of the inner frame 23 in the region of the extraction opening 24, created by forming the extraction opening 24 as a closed shape within the inner frame blank 1, helps to resist this compressive force and protects the group of cigarettes 20 from crushing. In addition, the side panels 12, 13, end panels 8, 10 and strengthening tabs 16, 18 also help to increase the structural rigidity and strength of the inner frame 23 and so resist the compressive force created by the low pressure.

The wrapped bundle 30 illustrated in FIG. 4 and FIG. 7 may be stand-alone packaging for tobacco industry products. That is, the wrapped bundle 30 may be distributed and sold without further packaging.

Figure 9:
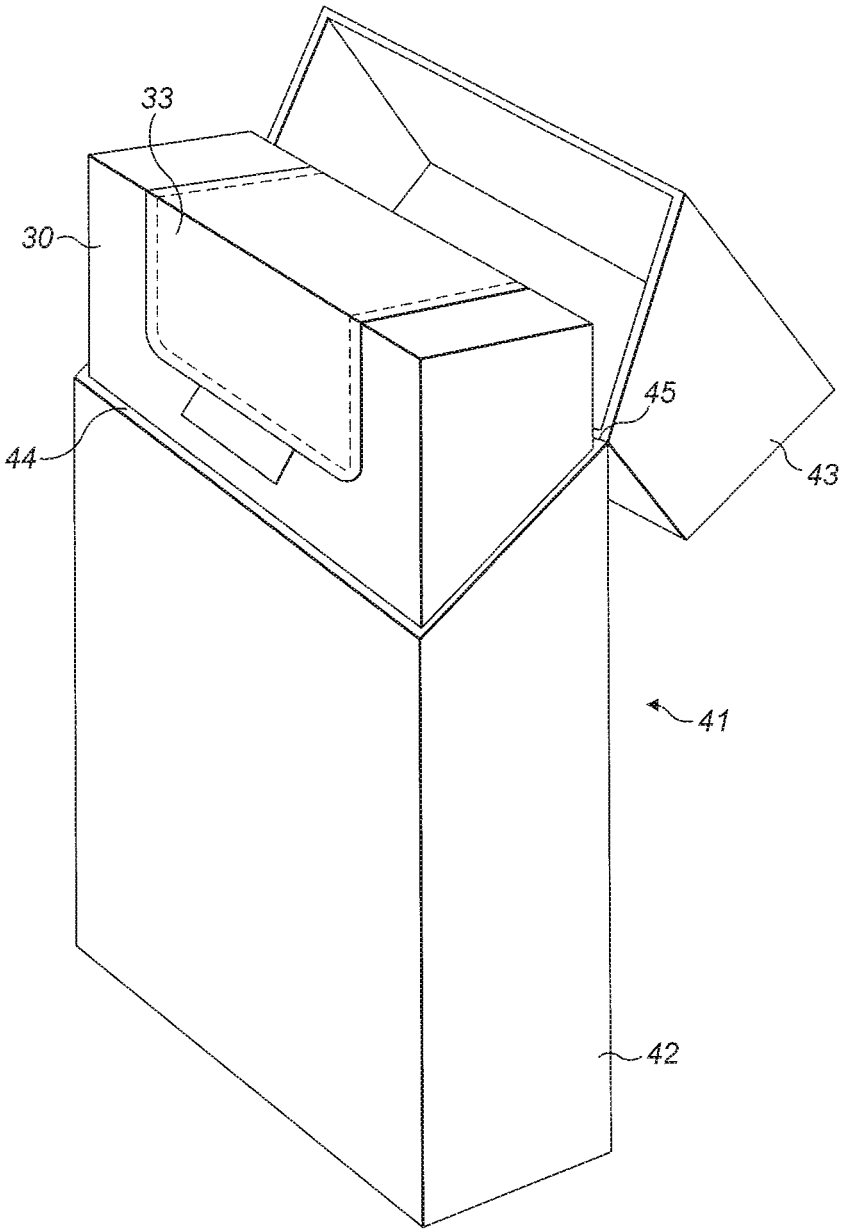
FIG. 9 shows a hinged lid pack that contains the wrapped bundle of FIG. 4 or FIG. 7.

Alternatively, as illustrated in FIG. 9, the wrapped bundle 30 may be disposed in a hinged-lid pack outer 41. The hinged-lid pack outer 41 has a parallelepiped base 42 and a parallelepiped lid 43. The wrapped bundle 30 is received in the base 42 and protrudes from an open end 44 of the base 42. The lid 43 is hingedly attached to the base 42 along a hinge line 45 and can pivot to cover the protruding part of the wrapped bundle 30. The resealing label 33 is accessible on the protruding part of the wrapped bundle 30, so that after opening the lid 43 a user can open the wrapped bundle 30 to extract cigarettes.

The packaging described above, in particular the hinged-lid pack 41, wrapped bundle 30, inner frame 23 and wrapper 29, are described with reference to cigarettes. However, it will be appreciated that the packaging may alternatively be used to package any smoking article or tobacco industry product.

As used herein, the term "tobacco industry product" is to be understood as including smoking articles comprising combustible smoking articles such as cigarettes, cigarillos, cigars, tobacco for pipes or for roll-your-own cigarettes, (whether based on tobacco, tobacco derivatives, expanded tobacco, reconstituted tobacco, tobacco substitutes or other smokable material), electronic smoking articles such as e-cigarettes, heating devices that release compounds from substrate materials without burning such as tobacco heating products; and hybrid systems to generate aerosol from a combination of substrate materials, for example hybrid systems containing a liquid or gel or solid substrate.

In one embodiment, the tobacco industry product is a smoking article for combustion selected from the group consisting of a cigarette, a cigarillo and a cigar.

In one embodiment, the tobacco industry product is a non-combustible smoking article.

In one embodiment the tobacco industry product is a heating device which releases compounds by heating, but not burning, a substrate material. The material may be for example tobacco or other non-tobacco products, which may or may not contain nicotine. In one embodiment the heating device is a tobacco heating device.

In another embodiment the tobacco industry product is a hybrid system to generate aerosol by heating, but not burning, a combination of substrate materials. The substrate materials may comprise for example solid, liquid or gel which may or may not contain nicotine. In one embodiment, the hybrid system comprises a liquid or gel substrate and a solid substrate. The solid substrate may be for example tobacco or other non-tobacco products, which may or may not contain nicotine. In one embodiment the hybrid system comprises a liquid or gel substrate and tobacco.

The packaging described above, in particular the hinged-lid pack 41, wrapped bundle 30, inner frame 23 and wrapper 29, are described with reference to tobacco industry products, for example cigarettes. However, it will be appreciated that the packaging may alternatively be used to package non-tobacco-industry products. For example, the packaging may alternatively be used to packaging any consumer product, such as an article or a product. In examples, the packaging is used to package food products, electronics, or other consumer goods, such as for example tissues.

In order to address various issues and advance the art, the entirety of this disclosure shows by way of illustration various embodiments in which the claimed invention(s) may be practiced and provide for superior inner frame blank, inner frame, wrapped bundle, and pack for tobacco industry products. The advantages and features of the disclosure are of a representative sample of embodiments only, and are not exhaustive and/or exclusive. They are presented only to assist in understanding and teach the claimed features. It is to be understood that advantages, embodiments, examples, functions, features, structures, and/or other aspects of the disclosure are not to be considered limitations on the disclosure as defined by the claims or limitations on equivalents to the claims, and that other embodiments may be utilised and modifications may be made without departing from the scope and/or spirit of the disclosure. Various embodiments may suitably comprise, consist of, or consist essentially of, various combinations of the disclosed elements, components, features, pails, steps, means, etc. In addition, the disclosure includes other inventions not presently claimed, but which may be claimed in future.

The invention claimed is:

1. A wrapped bundle of tobacco industry products, the wrapped bundle comprising a group of tobacco industry products, an inner frame folded about the tobacco industry products, and a wrapper enclosing the inner frame and tobacco industry products, the inner frame comprising a first major panel and a second major panel joined to opposing first and second edges of a central panel along respective first and second fold lines such that the first and second major panels are folded relative to the central panel along respective first and second fold lines to form opposing sides of the inner frame, the inner frame further comprising first and second end panels joined to a respective edge of the first and second major panels along respective fold lines, the first and second end panels being arranged to overlie each other and form an end wall that is opposite the central panel and wherein the inner frame further comprises an aperture in at least the central panel that defines an extraction opening for removing tobacco industry products from within the inner frame, wherein the extraction opening extends over the first edge of the central panel and is spaced from the second edge, and wherein the wrapped bundle further comprises an adhesive label adhered to the wrapper to cover the extraction opening of the inner frame, and wherein the interior of the wrapped bundle comprises a pressure differential relative to the exterior of the wrapped bundle, the pressure differential comprising a partial vacuum of less than 500 millibar.

2. The wrapped bundle of claim 1, wherein the aperture extends from the central panel into at least one of the first and second major panels.

3. The wrapped bundle of claim 2, wherein the inner frame blank comprises a closed figure that defines the aperture.

4. The wrapped bundle of claim 1, further comprising at least one side panel attached to an edge of the first major panel or the second major panel such that the side panel is foldable to extend between said opposing sides of said inner frame.

5. The wrapped bundle of claim 4, wherein a strengthening tab extends from the side panel such that, the strengthening tab at least partially overlaps the central panel.

6. The wrapped bundle blank of claim 1, wherein the opposing edges of the central panel comprise score lines.

7. The wrapped bundle of claim 1, wherein the wrapper comprises an access flap that is aligned with the extraction opening.

8. The wrapped bundle of claim 7, further comprising a label applied to the access flap, the label comprising an adhesive such that the access flap is resealable.

9. The wrapped bundle of claim 8, wherein the label covers the access flap and overlies at least part of the wrapper outside of the access flap.

10. The wrapped bundle of claim 8, wherein the adhesive is pressure sensitive adhesive.

11. The wrapped bundle of claim 1, wherein the wrapper is sealably wrapped about the inner frame and tobacco industry products.

12. The wrapped bundle of claim 11, wherein the wrapper comprises fin seals.

13. The wrapped bundle of claim 1, further comprising a one-way valve for extracting air from within the wrapped bundle or for inserting gas into the wrapped bundle.

14. The wrapped bundle of claim 13, wherein the inner frame further comprises a valve aperture that is aligned with the one-way valve.

15. A pack of tobacco industry products, the pack comprising the wrapped bundle of claim 1, and a pack outer adapted to receive the wrapped bundle.

16. The pack of claim 15, wherein the pack outer comprises a hinged-lid pack outer having a parallelepiped base in which the wrapped bundle is received such that a portion of the wrapped bundle protrudes from the base, and a parallelepiped lid arranged to cover the portion of the wrapped bundle that protrudes from the base.

* * * * *